United States Patent [19]

Ueda et al.

[11] 4,398,652

[45] Aug. 16, 1983

[54] METHOD AND DISPENSER FOR DISPENSING BEER

[75] Inventors: Toshihiro Ueda, Ibaraki; Masamichi Imanishi; Takayoshi Miyano, both of Kyoto, all of Japan

[73] Assignee: Suntory Limited, Osaka, Japan

[21] Appl. No.: 199,240

[22] Filed: Oct. 21, 1980

[30] Foreign Application Priority Data

| | | | |
|---|---|---|---|
| Nov. 21, 1979 | [JP] | Japan | 54-151648 |
| Feb. 22, 1980 | [JP] | Japan | 55-22913[U] |
| May 12, 1980 | [JP] | Japan | 55-63173 |
| Jul. 9, 1980 | [JP] | Japan | 55-94379 |
| Jul. 14, 1980 | [JP] | Japan | 55-96741 |
| Jul. 15, 1980 | [JP] | Japan | 55-100484[U] |
| Aug. 6, 1980 | [JP] | Japan | 55-112100[U] |
| Aug. 6, 1980 | [JP] | Japan | 55-112101[U] |

[51] Int. Cl.[3] ..... B65D 25/48; B67D 3/04

[52] U.S. Cl. ..... 222/1; 222/479; 222/569

[58] Field of Search ..... 222/1, 478, 481, 481.5, 222/488, 567, 569, 572, 479; 239/558, 565, 566, 561, 522, 521; 220/85 SP; 251/120; 141/286

[56] References Cited

U.S. PATENT DOCUMENTS

| | | | |
|---|---|---|---|
| 2,492,327 | 12/1949 | Sheldon, Jr. | 141/286 X |
| 3,235,133 | 2/1966 | Zimmerman et al. | 222/567 X |
| 3,426,798 | 2/1969 | Chernak | 251/120 X |

FOREIGN PATENT DOCUMENTS

| | | | |
|---|---|---|---|
| 415780 | 9/1934 | United Kingdom . | |
| 451687 | 11/1934 | United Kingdom . | |
| 515975 | 6/1938 | United Kingdom . | |
| 631170 | 10/1949 | United Kingdom . | |
| 659764 | 10/1951 | United Kingdom . | |
| 775066 | 5/1957 | United Kingdom . | |
| 1042211 | 9/1966 | United Kingdom . | |
| 1501162 | 2/1978 | United Kingdom . | |
| 1526015 | 9/1978 | United Kingdom . | |
| 1532975 | 11/1978 | United Kingdom . | |
| 2001610 | 2/1979 | United Kingdom | 222/478 |

*Primary Examiner*—Robert B. Reeves
*Assistant Examiner*—Donald Hajec
*Attorney, Agent, or Firm*—Frishauf, Holtz, Goodman and Woodward

[57] ABSTRACT

The present invention provides a method and apparatus for dispensing beer, which have the same effect as conventional methods of discharging beer under the pressure of carbon dioxide gas, whereby a plurality of streams of beer is formed when beer is dispensed from a bottle, barrel, can, beer tap, etc. into a receiver. Also disclosed is a metal container embodying the present invention and which provides such a plurality of streams of beer. The beer dispensed according to the present invention has a creamy head of foam and a mild, soft taste.

39 Claims, 39 Drawing Figures

METHOD AND DISPENSER FOR DISPENSING BEER

BACKGROUND OF THE INVENTION

The present invention relates to a method and a dispenser for discharging beer from a can, bottle, barrel (hereinafter referred to as "container") or beer tap into a mug, glass, or the like (hereinafter referred to as "mug").

Conventionally, when beer is dispensed from a barrel of such large capacity as 10 or 25 liters (l) into a mug, the discharge of the beer into the mug has been effected at a considerably high speed under the pressure of carbon dioxide gas. The beer thus freshly dispensed has a very creamy head of foam and a mild taste caused thereby. However, since the discharge of beer under the pressure of carbon dioxide gas requires a special device and raises the cost, this method is not generally adopted for use with containers of 10 l or less capacity and instead the gravity discharge technique is commonly used. Various devices have been proposed to facilitate gravity discharge; however, most of the conventional ones are means for only making the discharge easy, for reducing the price of a device, or for making the cleaning of a device easy.

The head of foam plays a very important role in determining the taste of the freshly dispensed beer. It is well known that the finer the head of foam, the better the beer tastes. It is therefore a key point for obtaining the better taste of beer to have a suitable amount of creamy head of foam formed atop the beer dispenser in the mug. Further, air should not be allowed to mingle in the foam. However, the discharge of beer simply by means of gravity never allows the formation of creamy foam and the formation of coarse froth in the gravity discharge technique makes the taste of beer rough in comparison with beer discharged under the pressure of carbon dioxide gas. Though the use of publicly known devices sometimes makes it possible to obtain beer having somewhat fine foam, it hardly stands with the beer dispensed under the pressure of carbon dioxide gas in terms of both good foaminess and taste.

More particularly, the beer dispensed under the pressure of carbon dioxide gas is made to swirl in the mug at a relatively high speed and shearing stress resulting from the swirls of different speed causes the formation of very small bubbles of carbon dioxide gas in the beer composing the creamy head of foam. On the other hand, the discharge of beer by gravity can not afford enough swirling speed. When beer is discharged high above the mug to obtain a high swirling speed, the pouring beer beats the beer in the mug with air entrained, which causes the formation of large bubbles and makes the taste poor. Also a device to discharge beer from a container kept at a high place into a mug below at an increased speed through a hose or tube makes the system too complicated to be realized for practical use. The use of a dispenser comprising minute holes (FIG. 7), which is designed only to make bubbles smaller, offers a foam head of very small bubbles and makes the taste soft; however, bubbles are formed too excessively and reduce the quantity of beer kept in the mug. This is far from practical, since too much overflow of foam makes the handling messy and the excessively thick head of foam makes drinking awkward.

An object of the present invention is to provide a method and a dispenser for dispensing beer in which the merit of discharge under the pressure of carbon dioxide gas is successfully combined with the convenience of discharge by gravity.

SUMMARY OF THE INVENTION

The present invention may be embodied by establishing two or more streams of beer, which streams are made obtainable by making two or more openings on the container for dispensing beer, or by attaching a dispensing device, having two or more ports, to the opening on the container or by using a device which comprises separating plates and/or separating tubes designed to divide the flow of beer into two or more streams just before they are received in a mug. As mentioned above, in the present invention the beer is made to have two or more streams and it is desirable to have one of them made into a much smaller stream having a cross-sectional area of 20 $mm^2$ or less. It is especially preferable to make the width of such small stream in the range of 0.5–2.5 mm. What is referred to herein as the width of a stream means the broadest width of the stream, and indicates the maximum diameter in a case where the stream takes the form of a cylinder, indicates the length of the longer side of its rectangular cross section in a case where it assumes the form of a ribbon, and indicates the diameter of a droplet when it pours in droplets. The width of a stream of beer changes depending not only on the diameter of a port from which the beer is discharged but also on the method of taking in air to replace the discharged beer and on the pressure inside the container. Moreover, though it is preferable to let the beer pour in a continued stream, it is not always necessary to pour the beer in an unbroken stream. It may be poured in droplets, either continuously or drop by drop. it is also desirable in dispensing the beer to keep a small stream from contacting other streams before they reach the receiver. In the case where a dispenser is used, it is desirable to have it designed in such a way as to have a coupling portion by which the dispenser is readily attached to the opening of a beer container itself or of a beer tap and detached therefrom, and a spout portion which divides the flow of beer into a plural number of streams. It is also desirable to make an air pressure portion which allows the passage of air into the container to replace the discharged beer. It is preferable to have the coupling portion fitted with a packing and the like to prevent the leakage of the liquid, if necessary. In the case where the beer container is a metal can (hereinafter referred to as "can") of a type which is made to tear open a V-shaped opening by means of a ring tab attached thereto (hereinafter referred to as "of pull-tab type"), the dispenser may be attached to its opening. A can of pull-tab type may have a dispenser attached to cover the opening either wholly or partially.

It is desirable for the spout portion to have a spout having one or more than one main pouring port and subsidiary pouring port respectively. These main and subsidiary pouring ports may be located on the same plane or on different planes. The diameter of a subsidiary pouring port should preferably be in the range of 0.8 mm and 4 mm and its cross-sectional area be 2 to 10% of the main port. Also the spout may be designed to have only one port with a separating plate and/or separating tube equipped close to the port to divide the flow of beer into two or more streams.

Another of the embodiments of the dispenser according to the present invention to be used on a can of pull-tab type mentioned above includes a cover-like device which covers the whole top end on which a pull-tab is provided instead of merely the opening left after the removal of the pull-tab. In this case, the fixing part of a dispenser may be made to fit in the double-seamed part of the top end partially or wholly. A main pouring port and a subsidiary pouring port may be provided on the cover in place of a spouting tube and an air intake port may be provided in place of an air intake pipe. If necessary, it is preferable to make a relief enclosure on the reverse side of the cover to enclose the main and subsidiary pouring ports and air intake port, the relief enclosure contacting the top end tightly around the opening made by the removal of the pull-tab.

Another embodiment may be a dispenser, which has a coupling portion, main and subsidiary pouring ports, and an air intake port, arranged to be fitted to the mouth of a beer bottle, etc. after the removal of a cap, etc.

The present invention may also be embodied by providing main and subsidiary ports and an air intake port on the can itself. Further, in the case of a can of pull-tab type mentioned above, the can may be designed to have a subsidiary plate shaped exactly like the top end equipped with a publicly known pull-tab. The subsidiary plate has main and subsidiary pouring ports and an air intake port made on it. The subsidiary plate is placed under the top end in such a way as to have all its ports arranged to face the opening made on the lid by the removal of the pull-tab. The top end and the subsidiary plate may then be double seamed together. Also, said subsidiary plate may be bonded to the reverse side of the top end instead of being double seamed together with the top end.

Furthermore, in a case where the flow of beer is divided into main and subsidiary streams by means of the main and subsidiary pouring ports, it is preferable to fit a guiding protrusion close to the head of the subsidiary stream to prevent it from being merged into the main stream pouring out vigorously.

According to the present invention, as described in the following examples, the beer poured out from a container or a beer tap by gravity has a creamy head of foam and tastes mild and good comparing quite well with beer discharged under the pressure of carbon dioxide gas.

DESCRIPTION OF THE PREFERRED EMBODIMENTS

Figure 1:
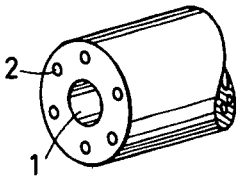
FIG. 1 is a perspective view of an embodiment of a beer dispenser of the invention.
Figure 2:
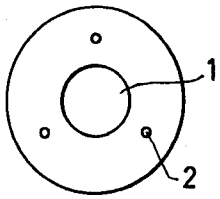
FIGS. 2 to 5 are end views of other embodiments of a beer dispenser of the invention.

The present invention will be described below in detail with reference to the following examples and the accompanying drawings.

EXAMPLE 1

Tin-plate cans having a capacity of 1 l were filled with beer, had their top ends double seamed, and were subjected to the following tests. In every test, care was exercised in pouring the beer not to allow the respective streams of beer to contact and merge with each other before they reached the receiver.

A. The test was conducted with a can which had two ports, one measuring 0.9 mm in diameter and the other 6 mm, made on one side of the lid for pouring out beer and an air intake port measuring 3 mm in diameter on the other side.

B. The test was conducted with a can which had two ports, one measuring 0.5 mm in diameter and the other 6 mm, made on one side of the lid for pouring out beer and an air intake port measuring 3 mm in diameter on the other side.

C. The test was conducted with a can which had one port measuring 1.0 mm in diameter and two ports, each measuring 6 mm, made on one side of the lid for pouring beer and an air intake port measuring 3 mm in diameter on the other side.

D. The test was conducted with a can which had one port measuring 9 mm in diameter made on one side of the lide for pouring out beer and an air intake port measuring 4 mm in diameter on the other side. The smaller of the two streams of beer obtained by the partition plate was made to have a width of 1.5 mm.

E. The test was conducted according to the preceding test D, wherein the width of the smaller stream of beer obtained by the partition plate was made to measure 2.0 mm.

F. The test was conducted by pouring beer from two cans, one having a port measuring 0.9 mm in diameter and the other measuring 6 mm, each can having an air intake port measuring 4 mm in diameter.

G. The test was conducted by pouring beer from the opening of an ordinary can of pull-tab type (for comparison).

| | Number of streams | Maximum width of small stream, mm | State of small stream |
|---|---|---|---|
| A | 2 | 0.9 | Continued thin stream |
| B | 2 | 0.5 | Dropwise |
| C | 3 | 1.0 | Continued thin stream |
| D | 2 | 1.5 | Continued ribbon-like stream |
| E | 2 | 2.0 | Continued ribbon-like stream |
| F | 2 | 0.9 | Continued thin stream |
| G | 1 | — | Continued very thick stream |

The sizes of the foams obtained in the respective tests A–F were compared and the result was as follows:

E>D>B>C>A=F

Also, the beer dispensed according to the respective methods of the present invention was compared with the beer of test G (comparison) and even the beer dispensed according to test E proved to have a markedly finer head of foam and noticeably better taste.

EXAMPLE 2

An explanatory description is given below referring to FIGS. 1 to 6 which show embodiments of basic dispensers according to the present invention.

Figure 3:
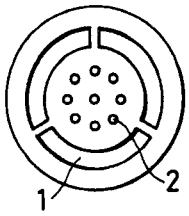
Figure 4:
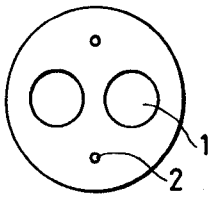
Figure 5:
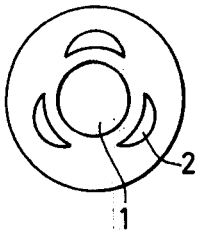

As shown in FIGS. 1 to 5, the main pouring port 1 and subsidiary pouring ports 2 are made to open on the same plane. A plurality of subsidiary pouring ports 2 each made in the form of a small port or slit may be arranged around the main pouring port 1 or they may be arranged in the central part of the device with main pouring ports 1 arranged therearound as shown in FIG. 3. A dispenser shown in FIG. 6 has its main pouring port 1 and subsidiary pouring port 2 opening on different planes. The shape and the number of the subsidiary pouring ports may be freely determined depending on the capacity and shape of the container and the quality of beer.

The dispenser of the present invention may be made integral with the top end of a container, or designed to be fitted to the opening of a container at the time of pouring out beer, or designed to be fitted to the opening of any conventionally known device which is made to discharge beer by gravity.

The foaminess and the taste were examined by pouring beer from a stainless steel beer barrel having a capacity of 5 l into a 500 ml mug with the use of various types of dispensers attached to the opening of the barrel. The following tests were carried out.

A. The dispenser used in the test was one as shown in FIG. 1, having a cylindrical body measuring 15 mm in diameter, a main port 1 having a diameter of 5.5 mm, and subsidiary pouring ports 2 each having a diameter of 1.2 mm.

Figure 6:
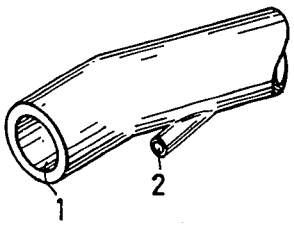
FIG. 6 is a perspective view of another embodiment of a beer dispenser of the invention.

B. The dispenser used in the test was one as shown in FIG. 6, having a main pouring port 1 measuring 5.5 mm in diameter and a subsidiary pouring port 2 measuring 1.0 mm. The subsidiary pouring port is located at a distance of 10 mm rearward below the main pouring port so that both streams of beer coming out of the two pouring ports would not contact each other.

C. A dispenser having only one pouring port measuring 15 mm in diameter was used (Comparison 1).

Figure 7:
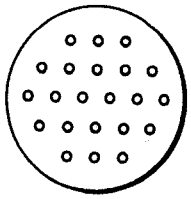
FIG. 7 is an end view of a comparison beer dispenser.

D. The dispenser used in the test was one as shown in FIG. 7 simply having twenty-two small pouring ports measuring 1.2 mm in diameter (Comparison 2).

E. Beer was dispensed from a beer bottle in the ordinary way of pouring (Comparison 3).

F. Beer was dispensed under the pressure of carbon dioxide gas (Control).

The results of tests:

| | Foaminess | | |
|---|---|---|---|
| | State of foam | Head of foam | Taste of beer |
| A | Creamy | Suitably thick | Mild |
| B | Creamy | Suitably thick | Mild |
| C | Large foam | Thin | Coarse |
| D | Creamy | Excessive | Mild |
| E | Large foam | Very thick | Coarse |
| F | Creamy | Suitably thick | Mild |

Note:
The state of foam was inspected visually and the taste of the beer was judged by five panelists.

The characteristics of the present invention is that it provides, as mentioned above, a simple method and a dispenser or dispensing cover of simple structure, with which beer can be poured from a container by gravity and the beer thus dispensed has a creamy head of foam and mild and good taste comparing quite well with beer poured under the pressure of carbon dioxide gas, allowing the user to enjoy the taste of draught beer easily.

Figure 8:
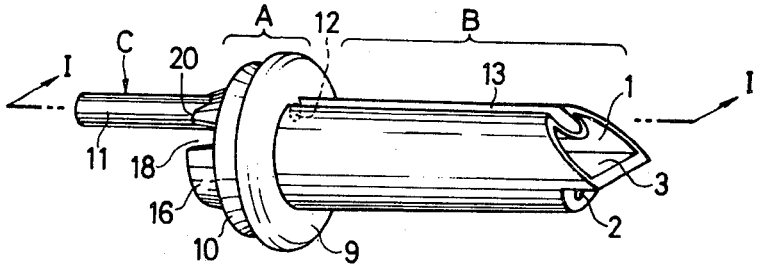
FIG. 8 is a perspective view of another embodiment of a beer dispenser of the invention.
Figure 9:
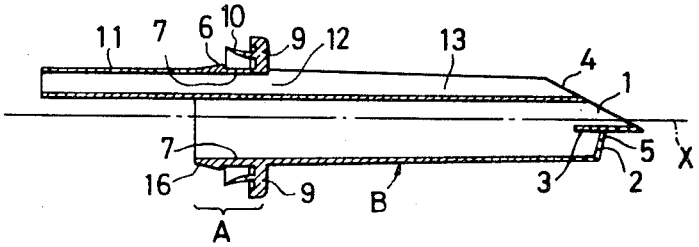
FIG. 9 is a cross-sectional view taken along a line I—I in FIG. 8.

Next referring to FIGS. 8 to 10, another embodiment of a spout-like dispenser according to the present invention is described below. In FIGS. 8 and 9, the dispenser comprises a coupling portion A which fits into an opening made on a container to pour out beer, a spout portion B, and an air passage portion C which admits air into the container to facilitate the discharge of beer.

The spout portion B is approximately made into the form of a cylinder except for its front end, where a main pouring port 1 and a subsidiary pouring port 2 are formed. The subsidiary pouring port 2 is set apart from the main pouring port 1 by a partition plate 3 which extends rearward from the front end to divide the flow of beer. The opening face 4 of the main pouring port 1 is set to make an angle of 90° or less with the axis X of the spout portion B. In the specific embodiment shown in the figures, the angle is set at about 30°.

The area of the opening face 4 is made approximately equal to the cross-sectional area of the spout portion B. The subsidiary pouring port 2 is provided on an end wall 5 at the end of the liquid passage formed by the partition plate 3 which divides the flow of beer. The area of the subsidiary pouring port 2 is made considerably small in comparison with the main pouring port 1, the area ratio being in the range of 2% to 10%. In FIGS. 8 and 9, the end wall 5 and the subsidiary pouring port 2 made thereon are located behind the main pouring port 1.

The above-mentioned partition plate 3 which works to divide the flow of beer is set horizontal in the spout portion 13 in such an unsymmetrical way as to make the cross-sectional area on the side of the main pouring port 1 larger than that on the side of the subsidiary pouring port 2.

As mentioned above, the opening face 4 of the main pouring port 1 is set to make an angle of 90° or less with the axis X of the spout portion B. This is done to increase the effective spouting area of the main pouring port 1. The degree of inclination of the opening face 4 is related to the length of the partition plate 3; however, the opening face 4 should be a face which covers the area extending from the front end of the partition plate 3, which divides the flow of beer, to an upper part of the walls of the spout portion B somewhat behind the rear end of said partition plate 3.

When the structure of the front end of the dispenser is made as mentioned above, it offers many outstanding advantages as given below.

A main stream of beer, which is discharged at a sufficiently high flow rate achieved by the main pouring port 1 having a large effective discharge area, and a subsidiary stream of beer, which is discharged from the subsidiary pouring port 2 designed to produce a sufficiently high discharge speed in spite of its small size, work together to give a creamy head of foam and a mild and good taste.

Figure 10A:
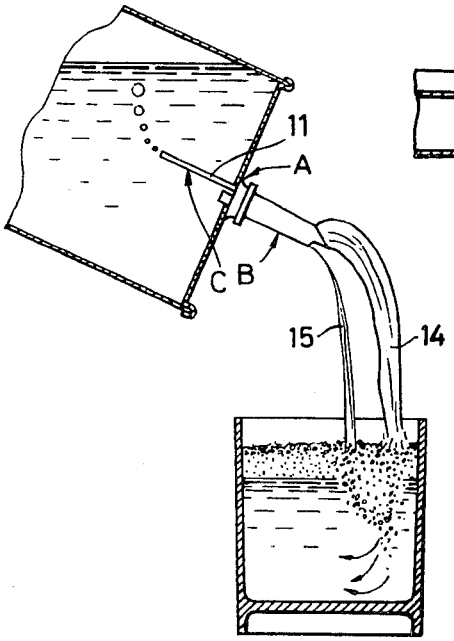
FIG. 10A is a cross-sectional view illustrating the performance of the beer dispenser of FIGS. 8 and 9.

To make the above-mentioned effect sufficiently great part of the flow of beer is directed by the partition plate 3 toward the subsidiary pourong port 2 in such a way as to give the subsidiary flow a considerably large cross-sectional area as compared with the subsidiary pouring port 2. In this way, the pressure of beer exerting on the subsidiary pouring port 2 is extremely high as compared with a case in which no partition plate 3 is provided, thus forming an effective subsidiary stream 15 pouring alongside the main stream 14 spouted from the main pouring port 1 as shown in FIG. 10A. The diameter of the subsidiary pouring port 2 should necessarily be made small to keep the bubbles small; however, it is also necessary to increase the flow rate of the stream of beer coming out of the subsidiary pouring port 2 to increase the number of tiny bubbles which subsequently form a creamy head of foam. However, if the diameter of the subsidiary pouring port 2 is extremely small, the subsidiary pouring port 2 may get clogged (stopped up) due to the surface tension and viscous resistance of beer. Therefore, care should be exercised in determining the diameter of the port.

The subsidiary pouring port 2 is located behind the front end of the partition plate 3 which separates the flow of beer to prevent the subsidiary stream 15 coming out of the subsidiary pouring port 2 from contacting the main stream 14 coming out of the main pouring port 1 before they reach the mug, since such contact ruins the effect which is expected of the subsidiary pouring port 2. Taking this point into consideration, it is necessary to keep some distance between the subsidiary pouring port 2 and the partition plate 3 which separates the flow of beer.

Figure 10B:
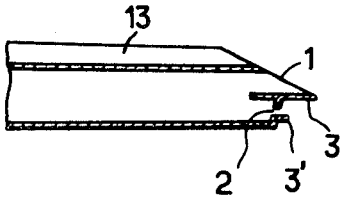
FIG. 10B is a cross-sectional view of another embodiment of the spout portion of the beer dispenser of FIG. 8.

Futhermore, it is preferable to provide an appendage 3' for the purpose of guiding the subsidiary stream 15 as shown in FIG. 10B so that the subsidiary stream 15 coming out of the subsidiary pouring port 2 may not merge into the main stream 14. The appendage 3' may be provided anywhere close to the flowing out portion of the subsidiary stream. It may be located at the upper, lower, right or left side of the port, or further may be provided as a pair of upper and lower appendages or right and left appendages. Moreover, the appendage may be made in any form of a rod, plate, prism, cone, pyramid or the like.

As for the length of the spout portion B in FIGS. 8 and 9, a greater flow rate can be obtained when it is made longer; however, a length of about 60 mm and a cross-sectional area of about 60 $mm^2$ are suitable for a container having a capacity of about 2 to 5 l. If it is made much larger than said dimensions, the resulting high flow rate and discharge speed make it difficult to properly point the direction of the streams of beer into the mug. If it is made too small, sufficient flow rate and discharge speed can not be obtained.

In a case where the spout portion B is made to have the above-mentioned dimensions, the diameter of the subsidiary pouring port 2 may be 1.3 mm to 3 mm, more preferably 1.5 mm to 2 mm.

The use of the above-mentioned dispenser according to the present invention makes the main stream 14 swirl in the mug entraining the tiny bubbles caused by the subsidiary stream 15, thus offering beer having a mild taste and a properly formed head of foam as shown in FIG. 10A.

The coupling portion A is a portion by which the spout portion B is mounted on the container. It may be made either integral with or separate from the spout portion B; however, it is advisable to have the dispenser of the present invention made integrally when it is to be molded from plastic material by the economical mass production method. The dispenser shown in FIGS. 8–10B is molded from plastic by an injection molding technique.

The coupling portion A comprises a cylindrical plug 7, having a slightly tapered sleeve 16 with a rim 6, which is made somewhat larger in diameter than the opening on the top end of a container for pouring out beer, formed around its base. A flared thin packing 10 extends from a press ring 9 which surrounds the root of said cylindrical plug 7. The dispenser is used by pressing the sleeve 16 into the opening exposed after the removal of the stopper on the container. At this time, the rim 6 is deformed for a moment when it is forced through the opening but then it resumes its form and couples tightly to the peripheral inner surface of the opening of the container. This firm coupling ensures a perfect sealing for the packing 10 with its elastic flare tightly pressing against the surface around the opening of the container, thus perfectly preventing the beer from leaking therefrom when it is poured from the dispenser. The press ring 9 makes the handling of the dispenser of the present invention easy, protects the packing 10, and furthermore has an effect to strengthen the whole structure of the dispenser itself.

The rim 6 is not necessarily made into a complete continuous circle and may have a plurality of slits 18 on it. The rim 6 may also be provided with a small rib 20 to guide the slightly tapered cylindrical plug 7 into the hole of a container.

The air passage portion C comprises a tube 11 which is equipped to the inner walls of the cylindrical plug 7 of the coupling portion A and is made long enough to extend into the container proper.

Tube 11 serves to let air pass into the container and facilitate the discharge of beer. When its length is made proper, it prevents the air, which is made to come into the container, from going out of the container entrained by the discharged stream of beer. If the tube 11 is too short, large bubbles of air may pass through the spout portion B along with the beer into a mug and the resulting large bubbles make the head of foam rough and damage the taste of beer. It is preferable to make the tube 11 measure 3 mm in inner diameter and about 30 mm in length, when the capacity of the container is in the range of 2 to 5 l and the cross-sectional area of the spout portion B is about 60 $mm^2$. When it is made longer, the flow rate of beer can also be increased.

When the tube 11 is formed as a unit with the inner walls of the cylindrical plug 7, with its air intake port made open on the periphery of the spout portion B and a semicircular groove 13 made in align with, and partly equal in shape to, the passage of the tube 11, the dispenser of the present invention can be made into a very compact structure and, at the same time, it can be manufactured from plastic very advantageously by injection molding with the use of a metal mold.

When beer runs through the tube 11 to flow over, though it occurs very rarely, it is conveniently led to the main pouring port 1 through the semicircular groove 13.

The spout portion B and other portions which are shown in the attached drawings are mostly designed to have a circular cross section, which, however, does not limit the present invention. They can also be made to have an eliptical or square cross section.

Figure 11:
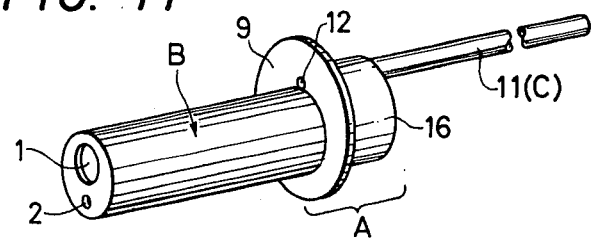
FIGS. 11 and 12 are perspective views of other embodiments of a beer dispenser of the invention.

FIG. 11 shows a simple spout-like dispenser according to the present invention which includes a main pouring port 1 having a diameter of 5 to 7 mm, a subsidiary pouring port 2 measuring 0.8 to 2 mm, preferably 1 mm, in diameter, and an air passage portion C measuring 80 mm or more in length and about 3 mm in inner diameter. The main pouring port 1 and the subsidiary pouring port 2 are kept apart 3 mm or more. Other dimensions can be determined freely as required. In this embodiment, the main and subsidiary pouring ports are made on the same plane. This dispenser also has a sleeve 16 and an air intake port 12. Here the same reference numerals are used to indicate parts and portions which are in common with those of the previously described embodiments.

Figure 12:
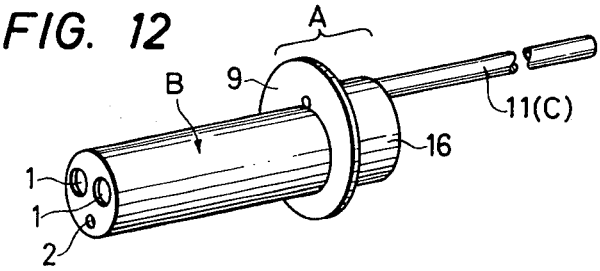
Figure 13A:
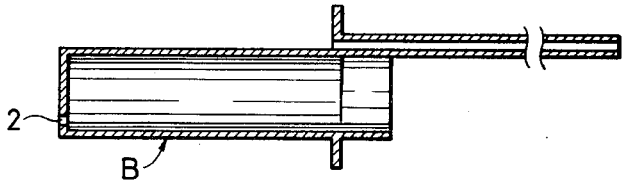
FIGS. 13A and 13B are cross-sectional views of the embodiment of FIG. 12.
Figure 13B:
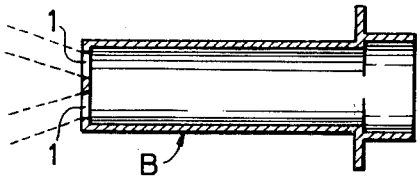

FIGS. 12, 13A and 13B show another variation of a dispenser which produces similar effects to that shown in FIG. 11. In FIG. 12, two main pouring ports 1, each having a diameter of 5 to 7 mm, preferably 6 mm, are made to pour out beer to each side as shown in FIG. 13B. By providing two main pouring ports 1, the diameter of each port can be made smaller to obtain enough creamy head of foam. By increasing the number of the main pouring ports 1, the time required for discharge can be shortened. A single subsidiary pouring port 2 is provided. It measures 0.8 to 2 mm, preferably 1 mm, in diameter. A tube 11, measuring 80 mm or more in length and 3 mm in inner diameter, is provided to allow the passage of air. The other dimensions may be determined as required.

In the two embodiments described above, the length of the tube 11 may be changed depending upon the height of a container. Generally, when the height of the container is low, the length of the tube 11 should be made shorter and as the height of the container increases, the length of the tube 11 should be made longer. In a case where the height of the container is about 210 mm to 350 mm, the length of the tube 11 should be 80 mm or longer. It should preferably be made 100 mm or more.

A still further embodiment of a dispenser according to the present invention will be described. In order to further increase the flow rate of beer, the end of the dispenser is left open instead of being closed as in the preceding embodiments and an open end wall 5' is used in the place of the aforementioned closed end wall 5 to make a main flow of beer and a subsidiary flow of beer respectively. This structure is shown in FIGS. 14A to 24, in which only the spout portion B is shown and the coupling portion A and/or the air passage portion C are omitted. They can be made to have the same shape and structure as shown in FIGS. 8 and 9 or other publicly known means.

Figure 14A:
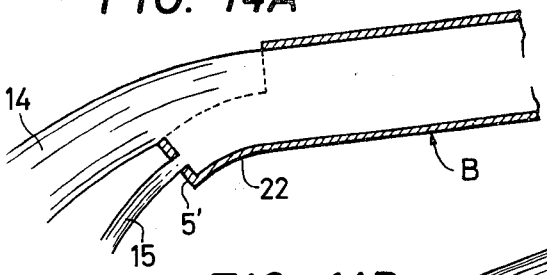
FIGS. 14A and 14B are respectively cross-sectional and perspective views of another embodiment of the spout portion of a beer dispenser of the invention.
Figure 14B:
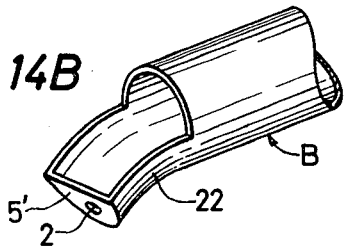

FIG. 14A shows a cross-sectional view of the dispenser shown in FIG. 14B. An end wall 5' is formed integrally with the spout portion B similar to the foregoing embodiments and a curved bottom 22 is somewhat bent downward to produce a subsidiary stream of beer 15.

Figure 15A:
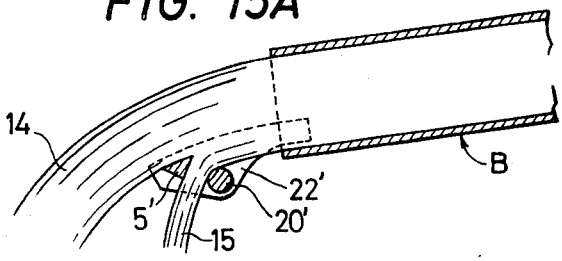
FIGS. 15A and 15B are respectively cross-sectional and perspective views of another embodiment of the spout portion of a beer dispenser of the invention.
Figure 15B:
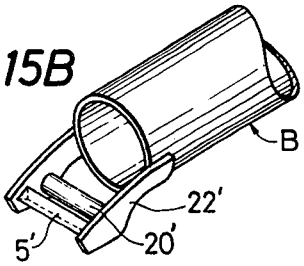

Similarly, FIGS. 15A and 15B show a dispenser which has a round rod 20' and a triangular variation of end wall 5' set horizontally. The round rod 20' is located somewhat below in front of the lower front end of the dispenser to cooperate with a triangular variation of end wall 5' which is provided in parallel with the round rod 20' to effect the separation of the flow of beer into the main and subsidiary streams. They are kept at a proper distance from the front end of the dispenser by a pair of supporting plates 22' as shown in FIG. 15B. Other suitable configurations may be selected as well.

The structures of the respective dispensers shown in FIGS. 14A to 24 have a common advantage that, since they provide a high discharge speed, the time required for discharging beer is short. The present invention is, of course, not limited to these specific embodiments and a wide variation is possible.

Figure 16:
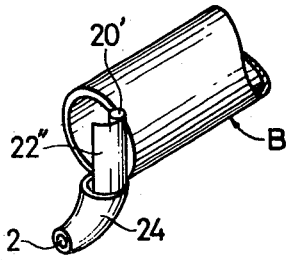
FIGS. 16 to 24 are perspective views of other embodiments of spout portions of a beer dispenser of the present invention.

FIG. 16 shows yet another variation of the dispenser according to the present invention particularly with regard to the pouring ports of the dispenser as shown in FIGS. 14 and 15. In this variation, a round rod 20' is provided to serve as a deflector for making a subsidiary flow of beer. The deflected flow of beer is received by a side plate 22'' and falls by gravity passing through a guide 24 to the subsidiary pouring port 2.

Figure 17:
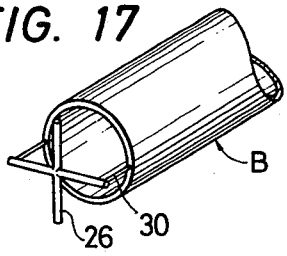
Figure 18:
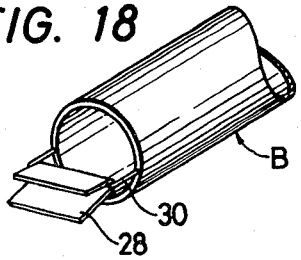
Figure 19:
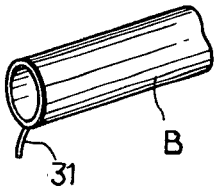
Figure 20:
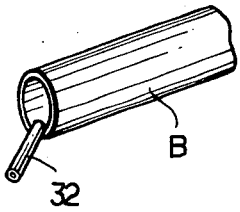
Figure 21:
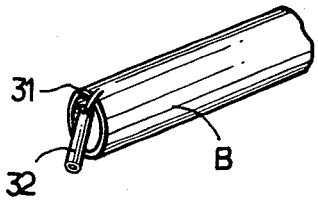
Figure 22:
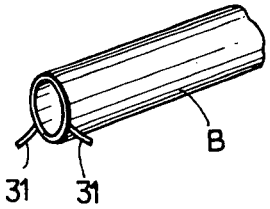

In the embodiment shown in FIG. 17, a cross-shaped rod member 26 is provided before the front end of the dispenser by a pair of supports 30. In yet another embodiment shown in FIG. 18, a folded separating plate member 28 is set off-center before the front end of the dispenser by a pair of supports 30.

Further preferred embodiments for obtaining a creamy head of foam according to the present invention will next be described. The present inventors have found that the size of bubbles which form the beer foam depends mainly on the dimensional relationship between the main pouring port 1 and the subsidiary pouring port 2. Also, the length of the tube 11 of the air passage portion C affects the discharge speed of beer at the pouring ports which also has a great influence on the formation of foam. A sufficiently long tube 11 for air passage is required to obtain a creamy head of foam resulting from very small bubbles.

In FIGS. 19 to 22, a separating plate 31 and/or a separating tube 32 is provided. The separating plate 31 is made in the form of a curved chute and beer forms a subsidiary stream while running along it.

Figure 23:
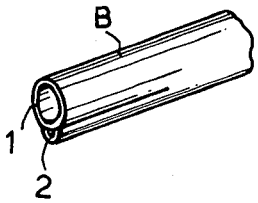
Figure 24:
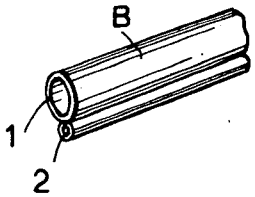

FIGS. 23 and 24 illustrate further embodiments of a dispenser, wherein the spout portion B is either throttled near its front end to form a twin tube or wholly made to form a twin tube, thus providing a main pouring port 1 and a subsidiary pouring port 2.

Figure 25:
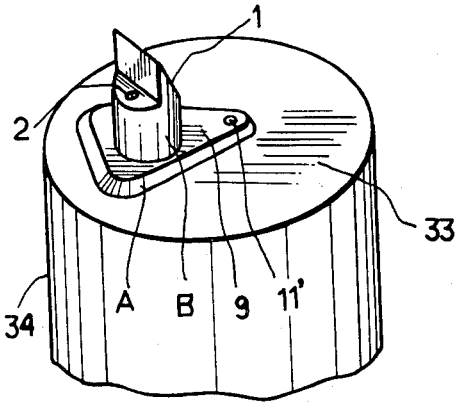
FIGS. 25 to 27 are respectively perspective and cross-sectional views of a can and a beer dispenser fitted to the opening made by the removal of the pull-tab of the can and a plan view of the beer dispenser.
Figure 26:
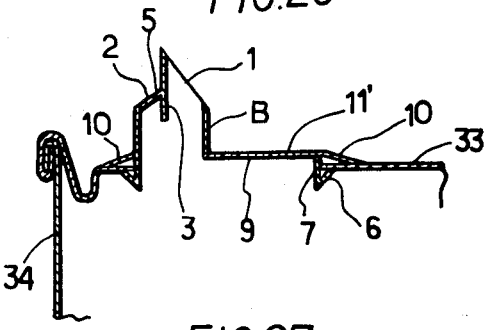
Figure 27:
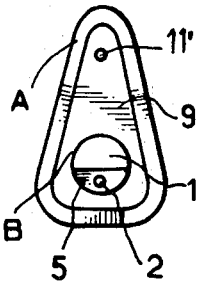

FIG. 25 is a perspective view of another variation of dispenser fixed to the V-shaped opening made by means of a conventional pull-tab on the top end 33 of a metal can 34. Its design is adapted from the dispenser shown in FIGS. 8 and 9. FIG. 26 shows the cross-sectional view of the dispenser fixed to the above-mentioned V-shaped opening and FIG. 27 is a plan view of the dispenser. In FIGS. 25 to 27, an air intake port 11' is provided in the dispenser in place of the tube 11 of the air passage portion C shown in FIGS. 8 and 9.

Figure 28:
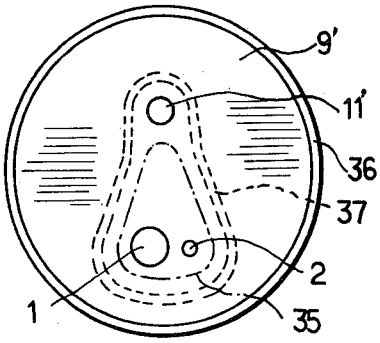
FIGS. 28 to 30 are respectively a plan view of a cover-like dispenser to be fitted to cover the opening made by the removal of the pull-tab of the can and cross-sectional views of the dispenser fitted to the can.
Figure 29:
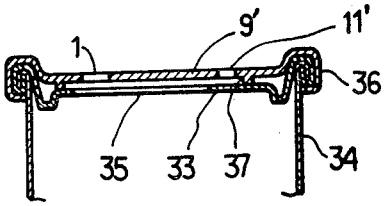
Figure 30:
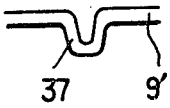

FIG. 28 is a plan view showing another embodiment of a dispenser designed in the form of a cover to cover the opening 35 (shown by a long and short dash line) made by the removal of a conventional pull-tab. FIG. 29 is a cross-sectional view and FIG. 30 is a partial cross-sectional view of the embodiment of FIG. 28. In FIG. 28, a coupling rim 36 may be formed either wholly or partially. A relief enclosure 37 (shown by dotted lines) is made on the reverse side of the dispenser to closely contact the surface of the top end 33 and enclose the opening 35 caused by the removal of the pull-tab, with a main pouring port 1, subsidiary pouring port 2, and air intake port 11' arranged therein. The surface of the body 9' of a dispenser may be depressed along the relief enclosure 37 as shown in FIG. 30. The relief enclosure 37 combines the functions of preventing beer from leaking at the time of dispensing and of minimizing the beer which may remain between the top end 33 of a can and the body 9' of a dispenser.

Figure 31:
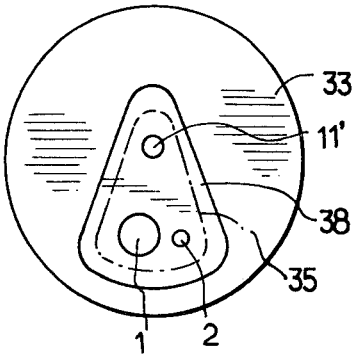
FIGS. 31 to 33 are respectively a bottom view of the lid showing the state of a subsidiary plate fitted to the reverse side of the top end processed to have a pull-tab and cross-sectional views showing how the subsidiary plate is fitted to the lid.
Figure 32:
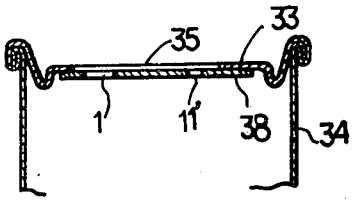
Figure 33:
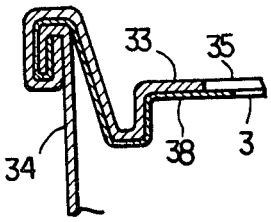

FIG. 31 shows another embodiment of a dispenser to be applied to the aforementioned opening 35 (shown by a long and short dash line) made by the removal of a pull-tab, wherein an auxiliary plate is attached to a metal can processed to have a pull-tab. More particularly, the auxiliary plate 38 having a main pouring port 1, subsidiary pouring port 2 and air intake port 11' is fixed to the reverse side of the top end 33 and these ports 1, 2, and 11' are all arranged to open in the area of the opening 35. FIG. 32 shows its cross-sectional view. In both FIG. 31 and FIG. 32, the auxiliary plate 38 is bonded to the reverse side of the top end 33 only to cover the area of the opening 35; however, the auxiliary plate 38 may be made in the same shape as the top end 33 and double seamed together as shown in FIG. 33. In case of FIG. 33, the auxiliary plate 38 may not necessarily be bonded to the top end 33, it may work satisfactorily so far as it is made to contact or to be close to the reverse side of the top end 33. In the case of FIGS. 31 to 33, when the container is opened by means of a pull-tab, the main pouring port 1, subsidiary pouring port 2, and air intake port 11' are in registration with the opening 35 to allow beer to pour out in two streams.

Figure 34:
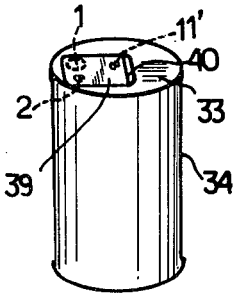
FIGS. 34 and 35 are respectively a perspective view and a plan view of a can on which main and subsidiary pouring ports and an air intake port are provided.
Figure 35:
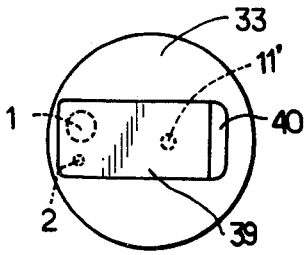

FIG. 34 is a perspective view of a dispensing means which comprises a main pouring port 1, subsidiary pouring port 2, and air intake port 11' (each shown by a dotted line) made directly on a metal container. FIG. 35 shows a plan view thereof. The above-mentioned ports 1, 2, and 11' are hermetically sealed with an adhesive sheet material 39, such as a laminated tear strip (U.S. Pat. No. 4,116,359), which is publicly known by the trade name of "Envirotab", applied to either the front side or to both the front and reverse sides of the top end 33. The container can be opened by pulling off the adhesive sheet material by means of a pull tab 40 attached thereto.

What is claimed is:

1. A beer dispenser comprising:

a coupling portion (A), a spout portion (B) and an air passage portion (C), all coupled together;

said spout portion (B) comprising a cylindrical tube portion having a semicircular groove (13) extending longitudinally thereon, a partition plate (3) with a predetermined length extending rearward from the front end of said cylindrical tube portion, a main pouring port (1) being formed above said partition plate (3), an opening face (4) formed at said main pouring port (1) and being set to make an angle of 90° or less with the axis of said cylindrical tube portion, an end wall (5) provided below said partition plate (3) at a position between the front end of said partition plate and the upper edge of said opening face (4) of said main pouring port, a hole (2) in said end wall (5) which forms said subsidiary pouring port, and the area ratio between the area of said subsidiary pouring port (2) and the effective area of said main pouring port (1) being in the range of 2 to 10%;

said coupling portion (A) comprises a slightly tapered sleeve (16) having a rim (6) with a diameter larger than an opening of a beer container to which the dispenser is to be coupled, a press ring (9) surrounding the front end of said coupling portion, and a thin packaging (10) extending rearward from said press ring (9); and said air passage portion (C) comprises air intake port (12) which opens through said press ring (9) into said semicircular groove (13), and a tube (11) extending rearward from said air intake port (12).

2. A beer dispenser according to claim 1, wherein said angle of said opening face (4) is approximately 30°.

3. A beer dispenser according to claim 1, wherein comprising at least one slit (18) in said slightly tapered sleeve (16).

4. A beer dispenser according to claim 1, wherein said pouring portion is substantially semicircular in cross-section.

5. A beer dispenser according to claim 1, wherein said spout-like tube further comprises a forward projecting appendage (3') extending forwardly of said subsidiary pouring port (2) for further preventing the beer flowing through said subsidiary pouring port from merging into the beer flowing out of the main pouring port.

6. A beer dispenser for use with a beer container having a pouring opening, the dispenser comprising:

a coupling portion (A) including means for easy attachment to and easy detachment from the opening of the beer container; and a spout portion (B) coupled to said coupling portion (A) for receiving beer to be poured from said container and forming said beer to be poured into a plurality of streams of beer;

said spout portion (B) having a front end portion, and including a spout-like tube having a main pouring port (1) and a subsidiary pouring port (2) at the front end portion of said spout portion; and said spout-like tube having a partition plate (3) therein separating said spout-like tube into said main pouring port (1) and said subsidiary pouring port (2), said partition plate being provided at the front end of said spout-like tube and extending rearward in said spout-like tube;

said main pouring port (1) having an opening face (4) which is set to make an angle 90° or less with the axis of said spout-like tube;

the area of said opening face (4) being approximately equal to the cross-sectional area of said spout-like tube;

the subsidiary pouring port (2) being considerably smaller in comparison with said main pouring port (1); and said subsidiary pouring port (2) having a front end which is situated behind said main pouring port (1).

7. A beer dispenser according to claim 6, wherein the opening face (4) of said main pouring port (1) comprises a face which covers the area extending from the front end of said partition plate (3) to an upper part of the walls of said spout-like tube a short distance behind the rearward end of said partition plate (3).

8. A beer dispenser according to claim 6, wherein said dispenser further comprises an air passage portion (C) coupled at least to said coupling portion (A).

9. A beer dispenser according to claim 6, wherein said spout-like tube further comprises a forward projecting appendage (3') extending forwardly of said subsidiary pouring port (2) for further preventing the beer flowing through said subsidiary pouring port (2) from merging into the beer flowing out of said main pouring port (1).

10. A beer dispenser for use with a beer container having a pouring opening, the dispenser comprising:

a coupling portion (A) including means for easy attachment to and easy detachment from the opening of the beer container; and a spout portion (B) coupled to said coupling portion (A) for receiving beer to be poured from said container and forming said beer to be poured into a plurality of streams of beer;

said spout portion (B) having a front end portion, and including a spout-like tube having a main pouring port (1) and a subsidiary pouring port (2) at the front end portion of said spout portion; and said main and subsidiary pouring ports (1,2) including means for directing streams of beer passing therethrough away from each other.

11. A beer dispenser for use with a beer container having a pouring opening, the dispenser comprising:

a coupling portion (A) including means for easy attachment to and easy detachment from the opening of the beer container;

a spout portion (B) coupled to said coupling portion (A) for receiving beer to be poured from said container and forming said beer to be poured into a plurality of streams of beer; and an air passage portion (C) coupled at least to said coupling portion (A);

said spout portion (B) having a front end portion, and including a spout-like tube having a main pouring port (1) and a subsidiary pouring port (2) at the front end portion of said spout portion; and said main and subsidiary pouring ports (1,2) including means for directing streams of beer passing therethrough away from each other.

12. A beer dispenser for use with a beer container having a pouring opening, the dispenser comprising:

a coupling portion (A) including means for easy attachment to and easy detachment from the opening of the beer container; and a spout portion (B) coupled to said coupling portion (A) for receiving beer to be poured from said container and forming said beer to be poured into a plurality of streams of beer;

said spout portion (B) having a front end portion and including a spout-like tube having a main pouring port (1) and a subsidiary pouring port (2) at the front end portion of said spout portion; and said spout-like tube further comprising a forward projecting appendage (3') extending forwardly of said subsidiary pouring port (2) for further preventing the beer flowing through said subsidiary pouring port (2) from merging into the beer flowing out of said main pouring port (1).

13. A beer dispenser for use with a beer container having a pouring opening, the dispenser comprising:

a coupling portion (A) including means for easy attachment to and easy detachment from the opening of the beer container;

a spout portion (B) coupled to said coupling portion (A) for receiving beer to be poured from said container and forming said beer to be poured into a plurality of streams of beer; and an air passage portion (C) coupled at least to said coupling portion (A);

said spout portion (B) having a front end portion, and including a spout-like tube having a main pouring port (1) and a subsidiary pouring port (2) at the front end portion of said portion; and said spout-like tube further comprises a forward projecting appendage (3') extending forwardly of said subsidiary pouring port (2) for further preventing the beer flowing through said subsidiary pouring port (2) from merging into the beer flowing out of said main pouring port (1).

14. A beer dispenser according to any one of claims 10, 11, 12 or 13, wherein said coupling portion (A) comprises:

an insertion tube (7) having a circular rim (6) which is made somewhat larger in diameter than the opening of the beer container;

a press ring (9) encircling the root of said insertion tube (7); and a thin packing means (10) which flares over said circular rim (6) from said press ring (9) and which encircles the root of said insertion tube (7).

15. A beer dispenser according to claim 11 or 13, wherein:

said coupling portion (A) comprises an insertion tube (7) which is insertable in the opening of the beer container, said insertion tube (7) having inner walls; and said air passage portion (C) comprises a tube (11) which measures at least 80 mm in length and at most 3 mm in inner diameter and which is attached integrally to the inner walls of said insertion tube (7) of said coupling portion, so that said tube (11) is insertable into the beer container.

16. A beer dispenser according to claim 11 or 7, wherein said main and subsidiary pouring ports are substantially round, and wherein the diameter of said main pouring port is 5 to 7 mm and the diameter of said subsidiary pouring port is 0.8 to 2 mm.

17. A beer dispenser according to any one of claims 10, 11, 12 or 13, wherein the cross-sectional area of said subsidiary pouring port is 2 to 10% of that of said main pouring port.

18. A beer dispenser according to claim 10 or 11, wherein said main and subsidiary pouring ports are on the same plane.

19. A beer dispenser according to any one of claims 10, 11, 12 or 13, wherein said main and subsidiary pouring ports are on the different planes.

20. A beer dispenser according to any one of claims 10, 11, 12 or 13, wherein said spout portion (B) comprises a pouring tube which has one pouring port provided with at least one of a separating plate and a separating tube in front of said pouring tube so as to separate a flow of beer passing through said one pouring port into at least two streams of beer.

21. A beer dispenser according to claim 20, wherein said pouring tube has a cylindrical tube portion having a semicircular groove (13) extending longitudinally thereon, and wherein said coupling portion (A) includes a port communicating with said semi-circular groove (13) for providing air communication from the inside of the container to the outside via said semi-circular groove (13).

22. A beer dispenser according to claim 20, wherein said spout-like tube further comprises a forward projecting appendage (3') extending forwardly of said subsidiary pouring port (2) for further preventing the beer flowing through said subsidiary pouring port from merging into the beer flowing out of the main pouring port.

23. A beer dispenser according to claim 10 or 11, wherein said pouring tube of said spout portion (B) comprises a twin tube near its front end to form said main pouring port and said subsidiary pouring port.

24. A beer dispenser according to claim 10 or 11, wherein said spout portion (B) comprises one pouring tube which has a main pouring port cut stepwise therein to form a trough, the one pouring tube having a front end which is provided with a small hole therein to form said subsidiary pouring port.

25. A beer dispenser of claim 24, wherein the portion of said pouring tube which has said stepwise cut formed therein is angulated downwardly so as to angulate said subsidiary pouring port to direct a stream of beer flowing therethrough away from the stream flowing through said main pouring port.

26. A beer dispenser according to claim 10 or 11, wherein:

said spout-like tube has a partition plate (3) therein separating said spout-like tube into said main pouring port (1) and said subsidiary pouring port (2), said partition plate being provided at the front end of said spout-like tube and extending rearward in said spout-like tube;

said main pouring port (1) having an opening face (4) which is set to make an angle of 90° or less with the axis of said spout-like tube;

the area of said opening face (4) is approximately equal to the cross-sectional area of said spout-like tube;

the subsidiary pouring port (2) is considerably smaller in comparison with said main pouring port (1); and said subsidiary pouring port (2) has a front end which is situated behind said main pouring port (1).

27. A beer dispenser according to claim 26, wherein the opening face (4) of said main pouring port (1) comprises a face which covers the area extending from the front end of said partition plate (3) to an upper part of the walls of said spout-like tube a short distance behind the rearward end of said partition plate (3).

28. A beer dispenser according to claim 26, wherein said coupling portion (A) includes means for fixing the dispenser to an opening of a metal container of beer, which opening is made by the removal of a pull-tab; and further comprising an air passage portion which includes a small port (12).

29. A beer dispenser according to claim 10 or 11, wherein said coupling portion (A) includes means for fixing the dispenser to an opening of a metal container of beer, which opening is made by the removal of a pull-tab; and further comprising an air passage portion which includes a small port (12).

30. A beer dispenser according to claim 10 or 11, which is adapted to be coupled to a metal container of beer having a pull-tab opening, wherein:

said coupling portion (A) includes a coupling rim for engaging at least a part of a round double-seamed edge of the top end of a container;

said coupling portion carrying a main pouring port (1), subsidiary pouring port (2), and air intake port (11') thereon; and a relief enclosure on the reverse side and which surrounds the pull-tab opening of the beer container to establish an air-tight contact between the cover and the top end of the beer container with said main and subsidiary pouring parts and air intake port arranged in the relief enclosure.

31. A beer dispenser according to claim 30, wherein said main and subsidiary pouring ports are substantially round, and wherein the diameter of said main pouring port is 5 to 7 mm and the diameter of said subsidiary pouring port is 0.8 to 2 mm.

32. A beer dispenser according to claim 30, wherein the cross-sectional area of said subsidiary pouring port is 2 to 10% of that of said main pouring port.

33. A beer dispenser according to claim 10 or 11, wherein said main and subsidiary pouring ports are angulated away from each other.

34. A beer dispenser according to claim 12 or 13, wherein said main and subsidiary pouring ports include means for directing streams of beer passing therethrough away from each other.

35. A beer dispenser according to claim 10 or 11, wherein said spout-like tube has at least two of said main pouring ports formed therein, and at least one of said subsidiary port formed therein.

36. A method for dispensing beer from a beer container into a receiver, by means of a dispenser, the method comprising:

forming, in said dispenser, the beer being poured from said container into a plurality of streams of beer, one of said streams being a main pouring stream and the other of said streams being a subsidiary pouring stream; and directing said main and subsidiary streams of beer flowing out of said dispenser in directions away from each other so that said main and subsidiary streams of beer diverge as they leave said dispenser.

37. The method of claim 36, wherein said dispenser is provided with main and subsidiary pouring ports through which said main and subsidiary streams of beer pass, respectively.

38. The method of claim 37, wherein said main pouring port has a diameter of from about 5 to 7 mm, and said subsidiary pouring port has a diameter of from about 0.8 to 2 mm.

39. The method of claim 36 comprising providing said dispenser with a forward projecting appendage (3') extending forwardly of said subsidiary pouring port for preventing beer flowing through said subsidiary pouring port from merging into beer flowing out of said main pouring port.

* * * * *

UNITED STATES PATENT AND TRADEMARK OFFICE

CERTIFICATE OF CORRECTION

PATENT NO. : 4,398,652

DATED : August 16, 1983

INVENTOR(S) : Toshihiro UEDA, et al

It is certified that error appears in the above-identified patent and that said Letters Patent is hereby corrected as shown below:

COLUMN 2, line 38, after "reach the receiver" begin a new paragraph with "In the case where a";

COLUMN 4, line 60, before "for pouring out beer" change "lide" to --lid--;

COLUMN 6, line 67, after "portion" change "13" to --B--;

COLUMN 9, line 11, after "made in" change "align with" to --alignment therewith--;

line 47, after "smaller to obtain" change "enough" to --a sufficient--;

COLUMN 11, lines 27-28, change "minimizing the beer" to --minimizing the amount of beer--;

COLUMN 14 (claim 16), line 54, change "claim 11 or 7" to --claim 11 or 12--.

Signed and Sealed this

*Twenty-eighth* Day of *February 1984*

[SEAL]

*Attest:*

*Attesting Officer*

GERALD J. MOSSINGHOFF

*Commissioner of Patents and Trademarks*